US005982109A

United States Patent [19]

Konopka et al.

[11] Patent Number: 5,982,109

[45] **Date of Patent: *Nov. 9, 1999**

[54] ELECTRONIC BALLAST WITH FAULT-PROTECTED SERIES RESONANT OUTPUT CIRCUIT

[75] Inventors: John G. Konopka, Barrington; Jeffrey D. Merwin, Buffalo Grove, both of Ill.

[73] Assignee: Motorola Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/062,479

[22] Filed: Apr. 17, 1998

[51] Int. Cl.[6] ..... H05B 37/02

[52] U.S. Cl. ..... 315/209 R; 315/205; 315/244; 315/307; 315/324

[58] Field of Search ..... 315/209 R, 244, 315/205, 307, 225, 324

[56] References Cited

U.S. PATENT DOCUMENTS

| | | | |
|---|---|---|---|
| 3,629,647 | 12/1971 | Lake et al. | 315/59 |
| 4,370,600 | 1/1983 | Zansky | 315/244 |
| 5,068,573 | 11/1991 | Bruning et al. | 315/209 R |
| 5,208,515 | 5/1993 | Lee | 315/225 |
| 5,357,173 | 10/1994 | Kachmarik et al. | 315/209 R |
| 5,399,944 | 3/1995 | Konopka et al. | 315/219 |
| 5,500,792 | 3/1996 | Jeon et al. | 363/98 |
| 5,528,117 | 6/1996 | Buij et al. | 315/324 |
| 5,546,300 | 8/1996 | Lee et al. | 363/132 |
| 5,581,161 | 12/1996 | Gong | 315/307 |
| 5,612,594 | 3/1997 | Maheshwari | 315/224 |
| 5,612,597 | 3/1997 | Wood | 315/293 |
| 5,615,093 | 3/1997 | Nalbant | 363/25 |

*Primary Examiner*—Michael B Shingleton
*Attorney, Agent, or Firm*—Kenneth D. Labudda

[57] ABSTRACT

An electronic ballast (100) for powering at least one gas discharge lamp (10) comprises an inverter (200) and an output circuit (300). Output circuit (300) comprises a resonant inductor (310), a resonant capacitor (330), a DC blocking capacitor (360), a first rectifier (350), and a second rectifier (370). Output circuit (300) prevents excessive current flow and power dissipation in the event of lamp removal or failure, and provides automatic ignition following lamp replacement. In an alternative embodiment, a ballast (160) for powering two lamps (10,20) includes a pair of modified output circuits (500,600) and a ground-referenced lamp return wire (504) for accommodating conventional instant-start type wiring.

13 Claims, 6 Drawing Sheets

ELECTRONIC BALLAST WITH FAULT-PROTECTED SERIES RESONANT OUTPUT CIRCUIT

FIELD OF THE INVENTION

The present invention relates to the general subject of circuits for powering gas discharge lamps and, in particular, to an electronic ballast with a fault-protected series resonant output circuit.

BACKGROUND OF THE INVENTION

Electronic ballasts typically include an inverter that provides high frequency current for efficiently powering gas discharge lamps. Inverters are generally classified according to switching topology (e.g., half-bridge or push-pull) and the method used to control commutation of the inverter switches (e.g., driven or self-oscillating). In many types of electronic ballasts, the inverter provides a square wave output voltage. The square wave output voltage is processed by a resonant output circuit that provides high voltage for igniting the lamps and a magnitude-limited current for powering the lamps in a controlled manner.

Several types of existing electronic ballasts employ a driven inverter and a series resonant output circuit. In such ballasts, the inverter and output circuit must be protected from the potentially damaging voltages and currents that may result when a lamp fault condition occurs. Common lamp fault conditions include lamp removal, lamp failure (e.g. degassed lamp), and failure of the lamp to conduct current in a substantially normal manner (e.g., diode-mode lamp).

Many existing protection circuits are quite complex and require a large number of components. As a result, the ballast tends to be costly and difficult to manufacture. A number of protection circuits have functional limitations as well. For example, many do not provide automatic ignition of a replaced lamp. Further, for ballasts that power multiple lamps, a number of existing protection circuits do not accommodate "true-parallel" operation of the lamps. For example, removal or failure of a single lamp is often responded to by either shutting down the inverter or operating the inverter at an elevated frequency. In either case, the remaining "good" lamps are prevented from continuing to provide a normal level of useful illumination.

It is therefore apparent that a need exists for an electronic ballast that is protected against various lamp fault conditions, that provides automatic ignition of replaced lamps, and that accommodates true-parallel operation of multiple lamps, but that does not require extensive protection circuitry. Such a ballast would be highly cost-effective, manufacturable, and reliable, and would therefore represent a significant advance over the prior art.

DETAILED DESCRIPTION OF THE PREFERRED EMBODIMENTS

Figure 1:
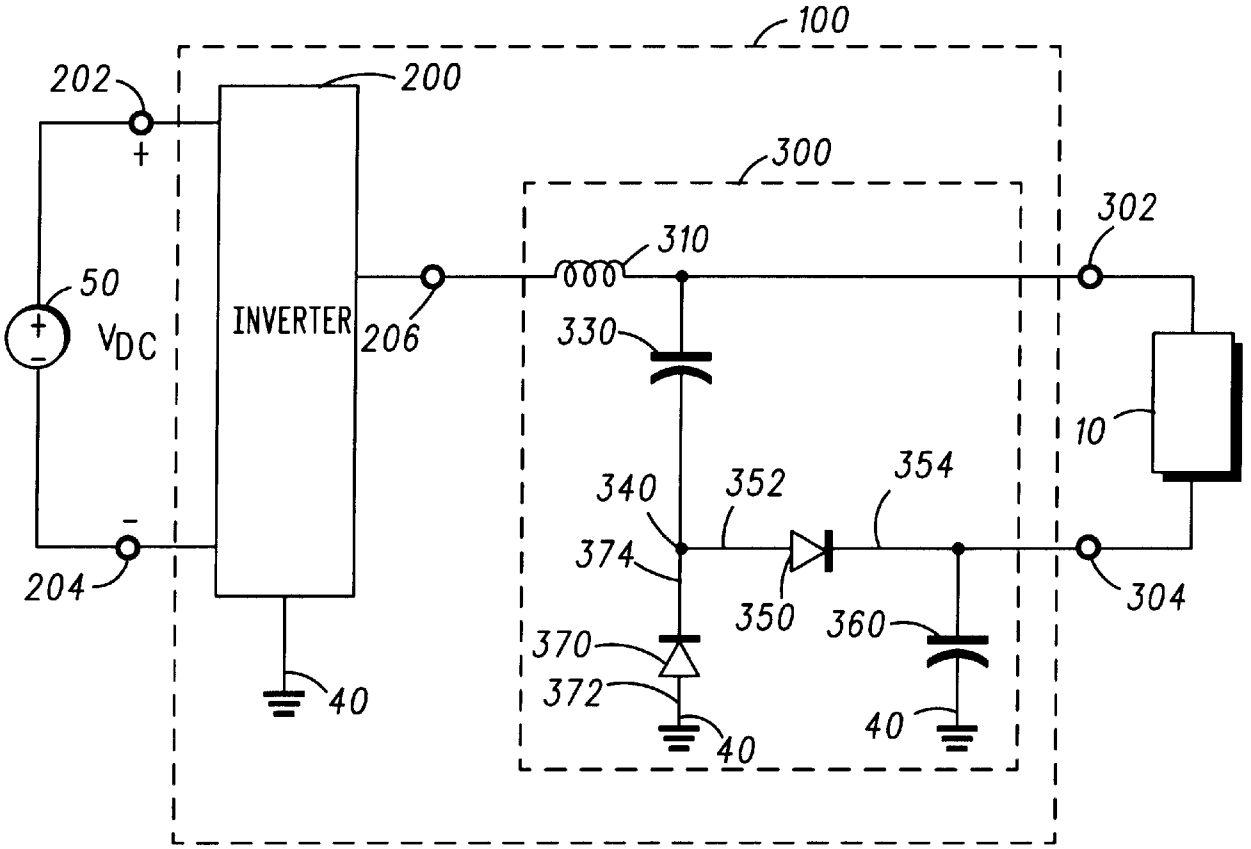
FIG. 1 describes an electronic ballast with a fault-protected series resonant output circuit, in accordance with a first preferred embodiment of the present invention.

An electronic ballast 100 for powering a gas discharge lamp 10 is described in FIG. 1. Ballast 100 comprises an inverter 200 and an output circuit 300. Inverter 200 includes first and second input terminals 202,204 and an inverter output terminal 206. Input terminals 202,204 are adapted to receive a source of substantially direct current (DC) voltage 50. Source 50 provides a voltage, $V_{DC}$, that is typically on the order of several hundred volts (e.g., 500 volts). $V_{DC}$ may be provided via rectification of a standard 120 volt or 277 volt alternating current (AC) supply using any of a number of AC-to-DC converter circuits, such as a diode bridge rectifier followed by a boost converter, or other suitable circuitry that is well-known to those skilled in the art of power supplies and electronic ballasts. Preferably, in order to ensure that sufficient voltage is present to operate lamp 10, $V_{DC}$ is chosen to have a value that is substantially greater than the normal operating voltage of lamp 10. For example, if lamp 10 is a F32T8 fluorescent lamp with a normal root-mean-square (rms) operating voltage of approximately 140 volts, $V_{DC}$ preferably should be set to at least about 500 volts.

During operation, inverter 200 provides a periodically varying voltage between inverter output terminal 206 and a circuit ground node 40. In a preferred embodiment, inverter 200 provides a substantially squarewave output voltage, such as that which is provided by a conventional half-bridge type inverter, wherein the voltage between inverter output terminal 206 and circuit ground node 40 periodically varies between a maximum value that is approximately equal to $V_{DC}$, and a minimum value that is approximately equal to zero.

Output circuit 300 comprises first and second output wires 302,304, a resonant inductor 310, a resonant capacitor 330, a first rectifier 350, a DC blocking capacitor 360, and a second rectifier 370. First and second output wires 302,304 are coupleable to gas discharge lamp 10. Resonant inductor 310 is coupled between inverter output terminal 206 and first output wire 302. Resonant capacitor 330 is coupled between first output wire 302 and a first node 340. First rectifier 350 has an anode 352 coupled to first node 340 and a cathode 354 coupled to second output wire 304. DC blocking capacitor 360 is coupled between second output wire 304 and circuit ground node 40. Second rectifier 370 has an anode 372 coupled to circuit ground node 40 and a cathode 374 coupled to first node 340.

During operation, ballast 100 develops a high voltage for igniting lamp 10, delivers operating power to lamp 10 after it ignites, and prevents potentially destructive high current and excessive power dissipation in inverter 200 and output circuit 300 following failure or removal of lamp 10. The detailed operation of output circuit 300 is explained in greater detail below.

Figure 2:
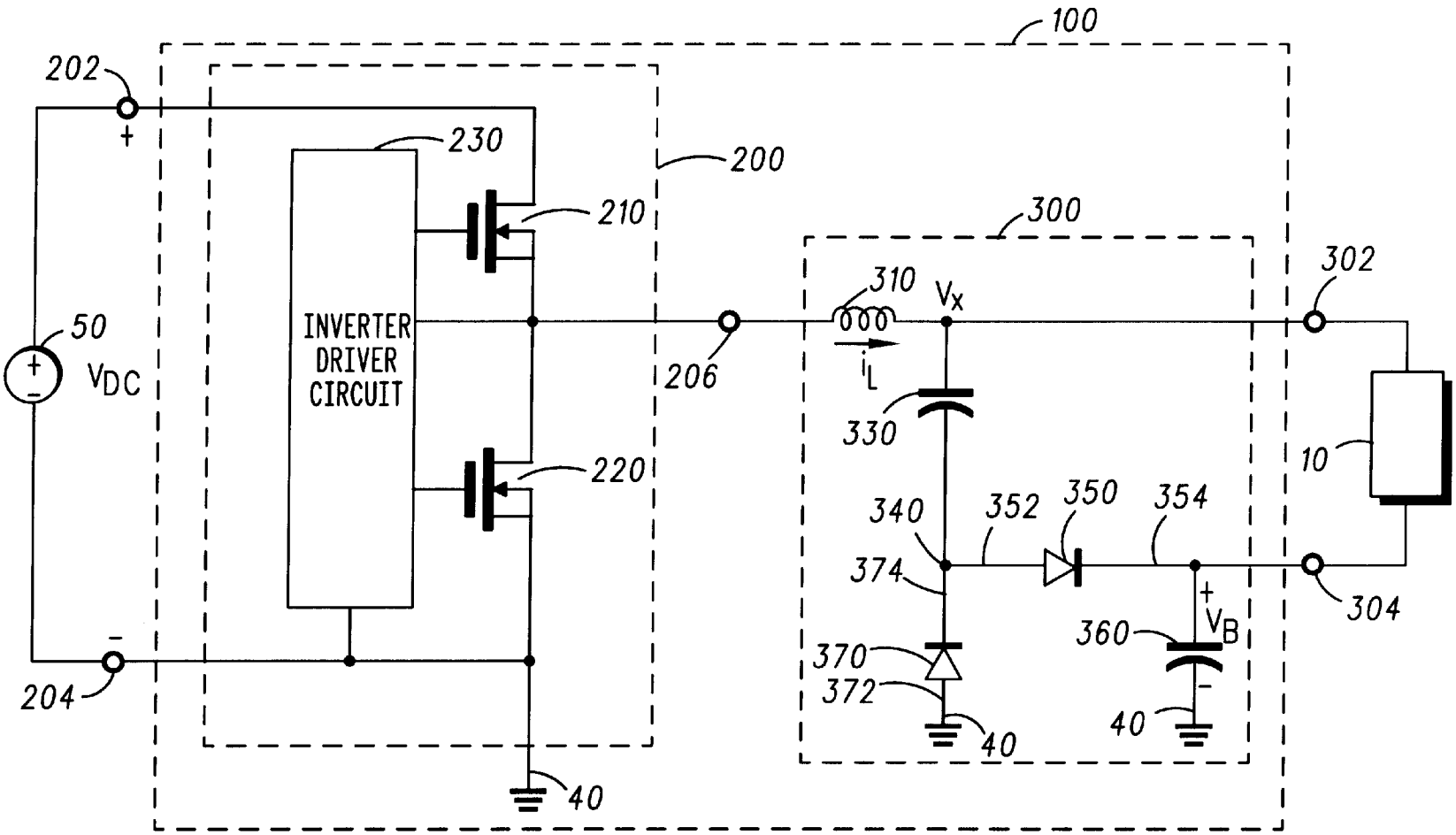
FIG. 2 describes an electronic ballast with a fault-protected series resonant output circuit and a half-bridge type inverter, in accordance with a first preferred embodiment of the present invention.

Turning now to FIG. 2, inverter 200 preferably further comprises a first inverter switch 210, a second inverter switch 220, and an inverter driver circuit 230. First inverter switch 210 is coupled between first input terminal 202 and inverter output terminal 206. Second inverter switch 220 is coupled between inverter output terminal 206 and circuit ground node 40. Second input terminal 204 is also coupled to circuit ground node 40. Inverter switches 210,220 are depicted as field-effect transistors (FETs), but may alternatively be implemented using other power switching devices, such as bipolar junction transistors (BJTs). During operation of inverter 200, inverter driver circuit 230 turns inverter switches 210,220 on and off in a substantially complementary fashion and, preferably, at a high frequency rate in excess of 20,000 Hertz. Inverter driver circuit 230 may be implemented using any of a number of well-known driver circuits, such as the IR2151 high-side driver integrated circuit manufactured by International Rectifier.

Although described in FIG. 2 as a half-bridge type inverter, inverter 200 may also be realized using any of a number of alternative inverter circuits that provide a periodically varying output voltage. For example, inverter 200 may be implemented as a single switch inverter substantially similar to that which is described in U.S. Pat. No. 5,399,944, the disclosure of which is incorporated herein by reference.

The detailed operation of ballast 100 and output circuit 300 is now explained with reference to FIG. 2 as follows. After power is applied to ballast 100, inverter 200 begins to operate and provides an approximately squarewave voltage between inverter output terminal 206 and circuit ground node 40. The squarewave output voltage periodically varies between zero and $V_{DC}$ at a high frequency rate that is preferably greater than 20,000 Hertz. With inverter 200 operating, a high frequency alternating current, $i_L$, flows through resonant inductor 310. During the positive half cycles of $i_L$, current flows from inverter output terminal 206 to circuit ground node 40 via resonant inductor 310, resonant capacitor 330, first diode 350, and DC blocking capacitor 360. During the negative half cycles of $i_L$, current flows up from circuit ground 40 and back to inverter output terminal 206 via second diode 370, resonant capacitor 330, and resonant inductor 310. Accordingly, DC blocking capacitor 360 charges up during the positive half cycles of $i_L$, and is prevented (by first diode 350) from discharging during the negative half cycles of $i_L$.

Within a short period of time (e.g., 100 milliseconds or less) after inverter 200 begins to operate and provide charging current to capacitor 360, $V_B$ reaches a value that is sufficiently high (e.g., 700 volts or so) to effect ignition of lamp 10. That is, the voltage applied to lamp 10, which is equal to the difference between $V_B$ and $V_X$, becomes high enough (e.g., 1000 volts or so) to initiate an arc in lamp 10. After lamp 10 ignites and begins to conduct a significant amount of high-frequency alternating current, $V_B$ decreases to a steady-state value that tends toward $V_{DC}/2$, which is the average value of the inverter output voltage. In practice, however, $V_B$ will actually be somewhat higher than $V_{DC}/2$, since capacitor 360 continues to receive a small amount of charging current via resonant capacitor 330 and first diode 350. The amount by which $V_B$ exceeds $V_{DC}/2$ is governed by the relative capacitances of capacitor 330 and 360. More specifically, an increased relative capacitance for resonant capacitor 330 tends to increase $V_B$, while a decreased relative capacitance for resonant capacitor 330 tends to decrease $V_B$.

If lamp 10 is not present in the first place, or fails to ignite, or is subsequently removed, $V_B$ will not level off as previously described, but will continue to increase. As $V_B$ increases, the current flowing through capacitors 330,360 decreases. In the absence of an ignited lamp, $V_B$ will tend toward a value that approaches $2*V_{DC}$. Once $V_B$ reaches its peak value of approximately $2*V_{DC}$, first diode 350 becomes non-conductive (since the voltage at anode 352 can no longer exceed the voltage at cathode 354) and current essentially ceases to flow in output circuit 300. With no current flowing in output circuit 300, ballast 100 dissipates little power and may thus continue to safely operate in an unloaded condition for an indefinite period of time. With capacitor 360 peak charged, $V_B$ remains at its peak value until at least such time as lamp 10 is replaced, in which case sufficient voltage will be present to ignite the lamp, or power is removed from ballast 100. Thus, in contrast with conventional series resonant output circuits, potentially destructive high currents and excessive power dissipation do not occur in inverter 200 and output circuit 300 when lamp 10 is not present, is removed, or fails to ignite. Further, ballast 100 provides automatic ignition of a replaced lamp by maintaining a high voltage across DC blocking capacitor 360.

The rate at which $V_B$ increases in response to lamp removal or failure is dependent, at least in part, upon the relative capacitances of capacitors 330,360. More specifically, a larger relative capacitance for capacitor 330 results in a faster rate of increase in $V_B$, while a smaller relative capacitance for capacitor 330 results in a slower rate of increase in $V_B$.

It is believed that, in addition to the aforementioned features, output circuit 300 provides an additional advantage relating to ballast operating efficiency. In contrast with conventional series resonant output circuits, output circuit 300 does not rely solely on resonant voltage gain (i.e., developing a high voltage across resonant capacitor 330) to ignite lamp 10. Thus, it is permissible to operate inverter 200 at a frequency that is considerably removed from the natural resonant frequency of resonant inductor 310 and resonant capacitor 330. Alternatively, resonant capacitor 330 may be chosen to have a significantly smaller capacitance than would otherwise be feasible in a conventional series resonant output circuit. It is believed that, in either case, the amount of current that flows through resonant capacitor 330 is significantly reduced in comparison with what occurs in a conventional series resonant output circuit. This results in a smaller root-mean-square (rms) current through resonant inductor 310, which results in reduced steady-state power losses in the inductor and/or permits use of physically smaller and less costly components for resonant inductor 310 and resonant capacitor 330.

In a practical implementation of ballast 100 and output circuit 300, there are a few design tradeoffs which should be understood with regard to selecting an appropriate capacitance for resonant capacitor 330. If resonant capacitor 330 has too low a capacitance relative to that of DC blocking capacitor 360, lamp 10 may not ignite properly. That is, resonant capacitor 330 may not provide sufficient current to capacitor 360 to maintain a high voltage across capacitor 360 during the glow transition period that typically precedes full ignition of lamp 10. More specifically, during the glow transition period, a small amount of alternating glow current flows through lamp 10 and DC blocking capacitor 360. This glow current tends to reduce the voltage across capacitor 360. Fortunately, resonant capacitor 330, if large enough, delivers sufficient charging current to negate the influence of the glow current and thereby maintains $V_B$ at a value that is high enough (e.g., 700 volts or so) to ensure successful ignition of lamp 10. On the other hand, if resonant capacitor 350 has a capacitance that is too large relative to that of DC blocking capacitor 360, the voltage across capacitor 360 will exceed $V_{DC}/2$ by a relatively large amount. Consequently, the current provided to lamp 10 will become noticeably asymmetrical, which is generally regarded as undesirable.

In a prototype ballast configured substantially as shown in FIG. 2, the capacitance of resonant capacitor 330 was on the order of several nanofarads, and the capacitance of DC blocking capacitor 360 was on the order of tenths of a microfarad.

Figure 3:
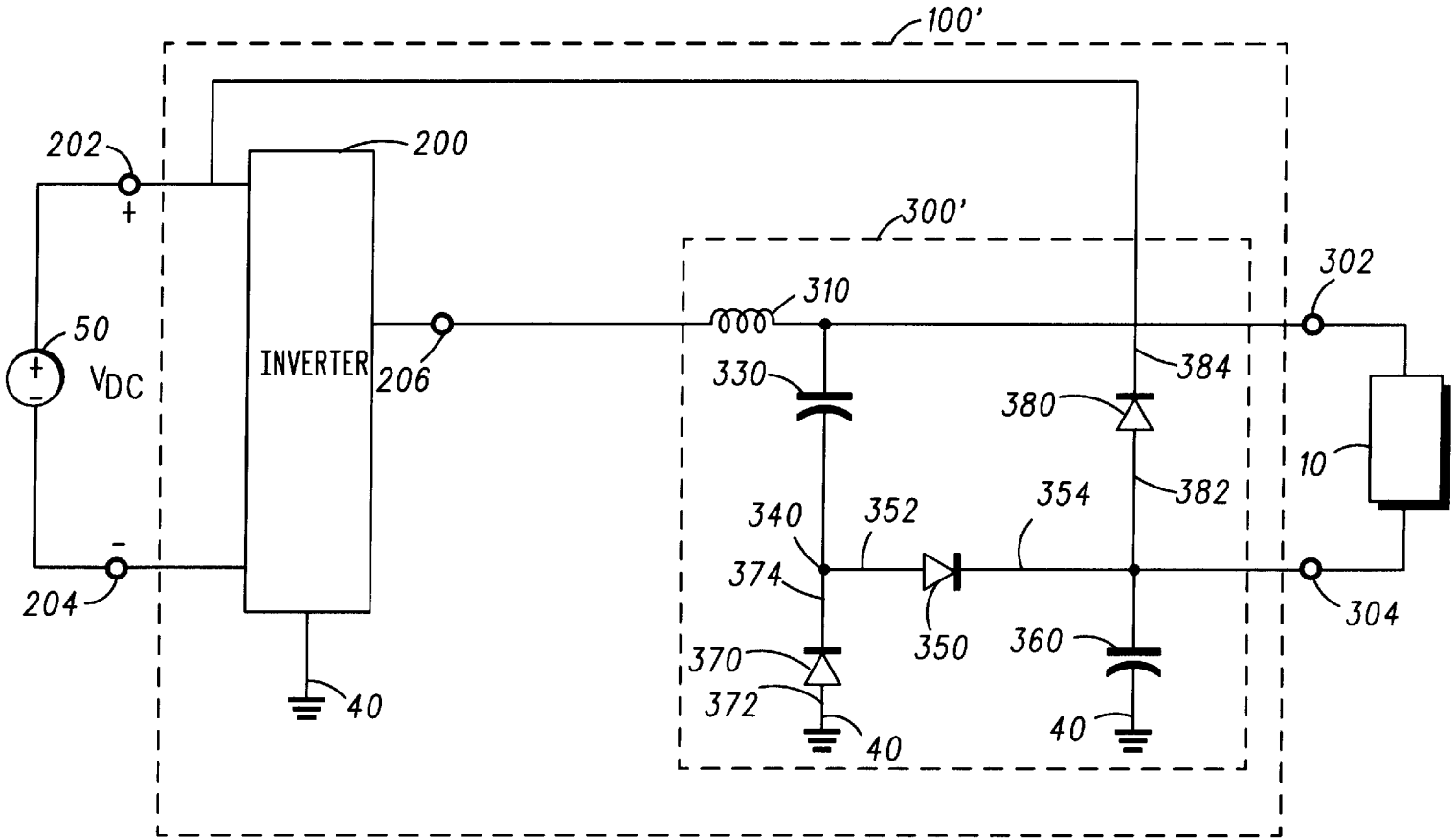
FIG. 3 describes an electronic ballast with a modified fault-protected series resonant output circuit that includes a voltage clamping diode, in accordance with the first preferred embodiment of the present invention.

Turning now to FIG. 3, ballast 100' includes a modified output circuit 300' that additionally comprises a clamping rectifier 380 having an anode 382 coupled to second output wire 304, and a cathode 384 coupled to the first input terminal 202 of inverter 200. Clamping rectifier 380 serves to prevent the voltage, $V_B$, across DC blocking capacitor 360 from exceeding $V_{DC}$. That is, if $V_B$ attempts to $V_{DC}$, diode 380 becomes forward-biased and thus ensures that $V_B$ can be no greater than $V_{DC}$. Clamping rectifier 380 is useful if practical design considerations necessitate a reduction in the peak voltages across DC blocking capacitor 360 and first and second rectifiers 350,370. As previously explained with reference to FIG. 2, if lamp 10 is removed or fails to conduct arc current, $V_B$ will reach a peak value that is approximately equal to $2*V_{DC}$. With clamping diode 380 present, however, $V_B$ is limited to $V_{DC}$, thus allowing capacitor 360, as well as diodes 350,370, to be realized using components with much lower voltage ratings. For example, if $V_{DC}$ is equal to 500 volts, and if clamping diode 380 is absent, capacitor 360 and diodes 350,370 will each have to be capable of withstanding voltages in excess of about 1000 volts. If clamping diode 380 is present, on the other hand, the same components need only withstand about 500 volts. In ballast 100', since the peak value of $V_B$ is limited to $V_{DC}$, it may be necessary to operate inverter 200 at a frequency that is reasonably close to the natural resonant frequency of resonant inductor 310 and resonant capacitor 330 in order to ensure that sufficient voltage is provided to ignite lamp 10.

Although the above description has focused on a ballast for powering a single gas discharge lamp, it should be appreciated that the present invention is also readily applicable to ballasts for powering two or more lamps. For example, FIG. 4 describes a ballast 120 for powering two gas discharge lamps 10,20. Ballast 120 includes two identical output circuits 300,400, each of which is coupleable to one of the lamps 10,20. More specifically, each output circuit 300,400 comprises a first output wire 302,402, a second output wire 304,404, a resonant inductor 310,410, a resonant capacitor 330,430, a first rectifier 350,450, a DC blocking capacitor 360,460, and a second rectifier 370,470, all of which are interconnected in the same manner as previously described with reference to FIGS. 1 and 2. More generally, a ballast for powering N lamps can be provided by employing N output circuits configured in analogous fashion to that which is described in FIG. 4.

Referring again to FIG. 4, since each lamp 10,20 has its own output circuit 300,400, ballast 120 provides true-parallel operation of the lamps. Thus, a fault in one lamp is handled by its respective output circuit without affecting operation of other "good" lamp. For example, if lamp 10 becomes degassed, output circuit 300 responds by peak charging DC blocking capacitor 360, which effectively shuts down output circuit 300, in the same manner as previously described. If lamp 20 remains present and is functional, output circuit 400 continues to supply operating power to lamp 20. Lamp 20 is thus allowed to continue to provide useful illumination, thereby avoiding or at least reducing the need for immediate replacement of the failed lamp.

Figure 4:
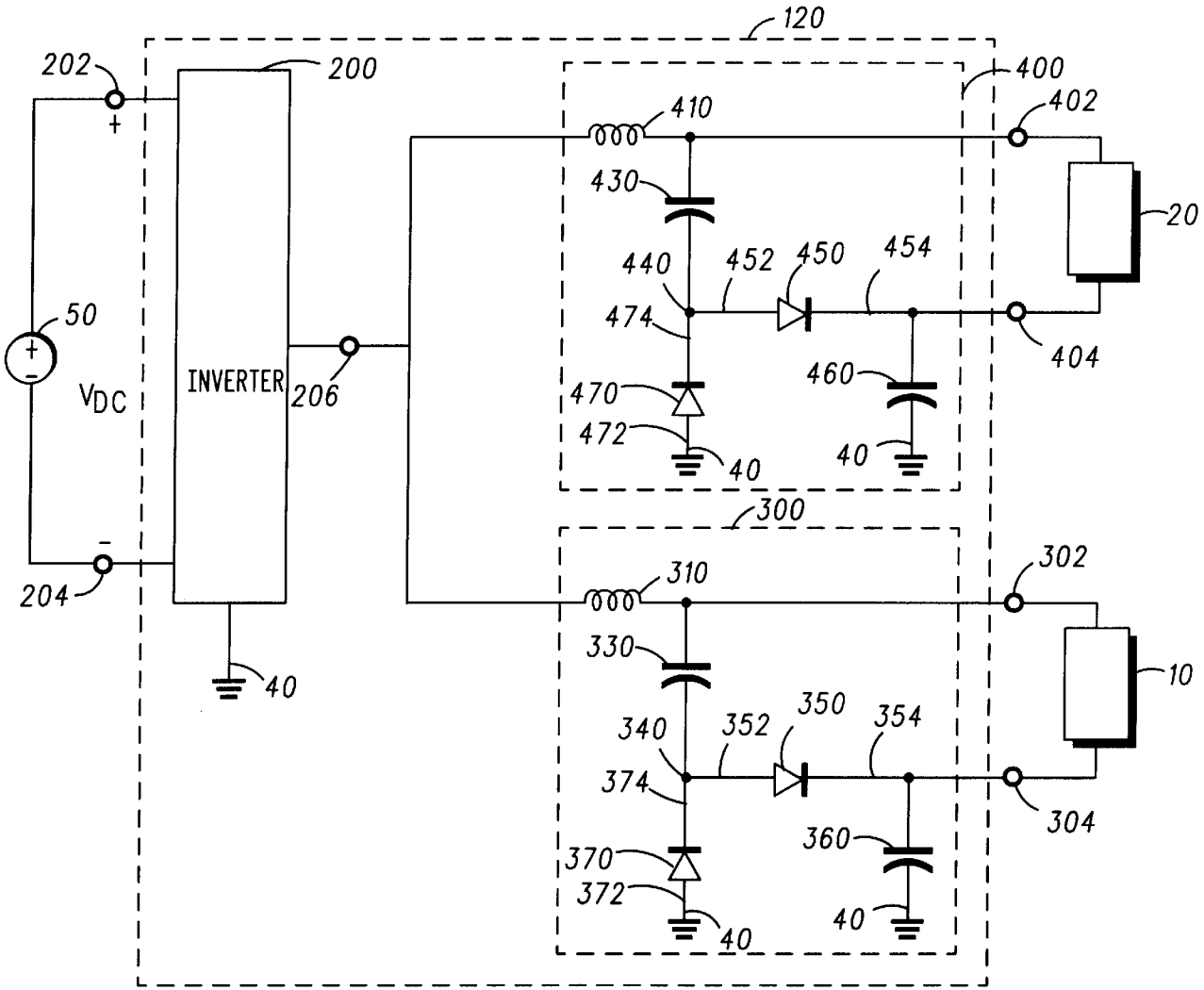
FIG. 4 describes an electronic ballast for powering two gas discharge lamps with dual fault-protected series resonant output circuits, in accordance with the first preferred embodiment of the present invention.

Although not described in FIG. 4, each output circuit 300,400 may optionally include a voltage clamping diode coupled between second output wire 304,404 and the first input terminal 202 of inverter 200, in similar fashion to that which was described previously with reference to FIG. 3.

Figure 5:
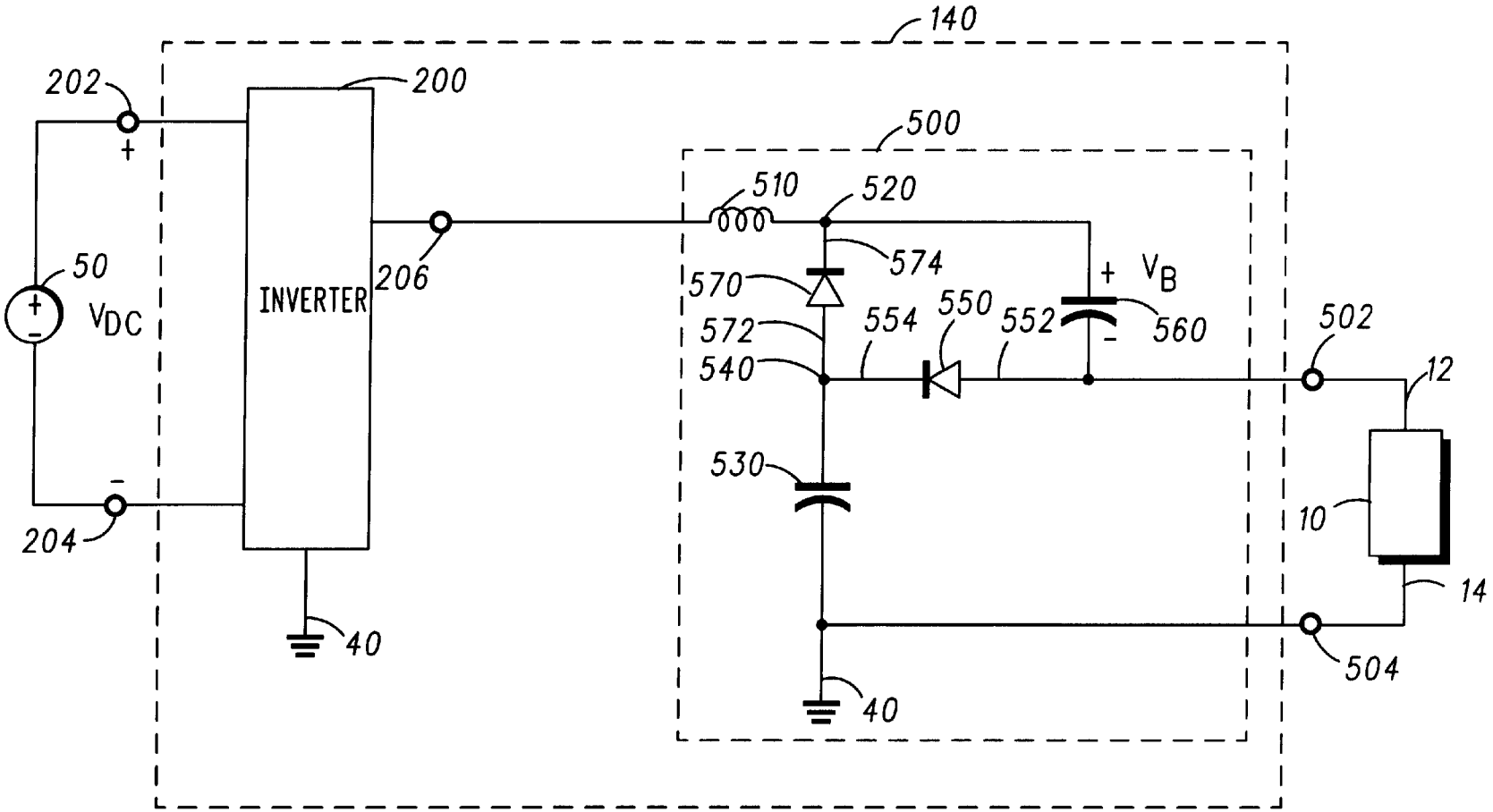
FIG. 5 describes an electronic ballast with a fault-protected series resonant output circuit that accommodates a common lamp return wire, in accordance with a second preferred embodiment of the present invention.

In the ballasts 100,100',120 described thus far, two output wires are required for each lamp. For a ballast that powers a single lamp, this is not problematic. For instant-start type ballasts for two or more lamps, however, conventional wiring requires only a single hot wire for each lamp, with all of the lamps sharing a common lamp return wire (i.e., the lower ends of the lamps are connected together). Ballast 140, which is described in FIG. 5, includes an output circuit 500 that accommodates such a wiring scheme. Output circuit 500 comprises a hot output wire 502, a lamp return wire 504, a resonant inductor 510, a DC blocking capacitor 560, a first rectifier 550, a resonant capacitor 530, and a second rectifier 570. Output wire 502 is coupleable to a first end 12 of gas discharge lamp 10. Lamp return wire 504 is coupled between circuit ground node 40 and is coupleable to a second end 14 of lamp 10. Resonant inductor 510 is coupled between inverter output terminal 206 and a first node 520. DC blocking capacitor 560 is coupled between first node 520 and output wire 502. First rectifier 550 has an anode 552 coupled to output wire 502, and a cathode 554 coupled to a second node 540. Resonant capacitor 530 is coupled between second node 540 and circuit ground node 40. Second rectifier 570 has an anode 572 coupled to second node 540 and a cathode 574 coupled to first node 520.

Structurally, output circuit 500 is a rearranged version of output circuit 300, with the significant difference that output circuit 500 has its lamp return wire 504 coupled to circuit ground node 40. For ballasts that power multiple lamps, this allows a reduction in the number of required output wires between the ballast and the lamps. The detailed operation of output circuit 500 is believed to be substantially similar to that which was previously described for output circuit 300, the main difference being in the polarities of the voltages and currents of the components.

Figure 6:
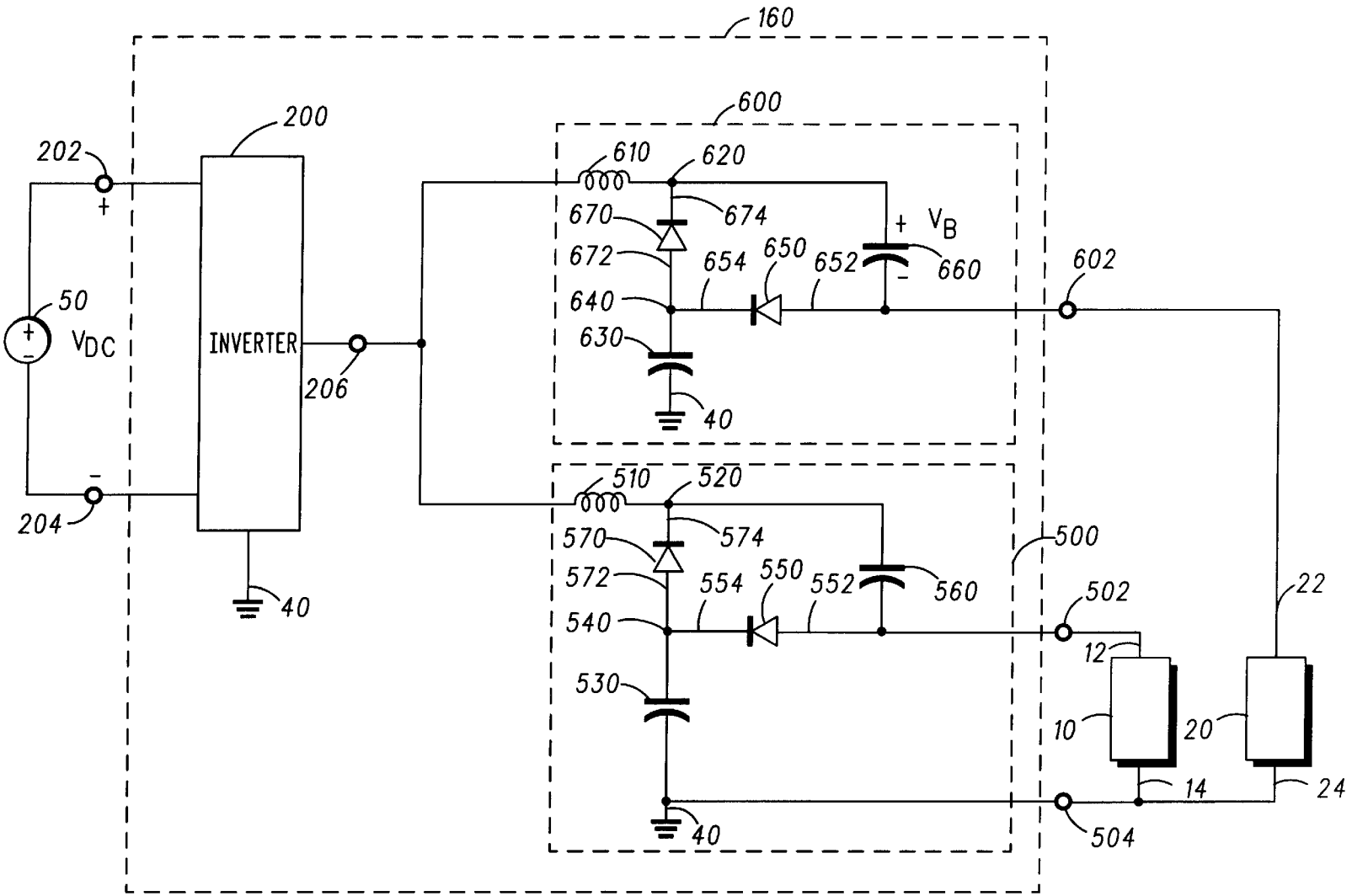
FIG. 6 describes an electronic ballast for powering two gas discharge lamps with dual fault-protected series resonant output circuits and a common lamp return wire, in accordance with the second preferred embodiment of the present invention.

FIG. 6 describes a ballast 160 for powering two gas discharge lamps 10,20. Ballast 160 includes two identical output circuits 500,600. Each output circuit 500,600 has a hot output wire 502,602 coupleable to a first end 12,22 of its respective lamp 10,20. Ballast 160 further includes a lamp return wire 504 coupled to circuit ground node 40 and coupleable to the second ends 14,24 of lamps 10,20. Because lamp return wire 504 is coupled to circuit ground node 40, only three wires 502,504,602 are required between ballast 160 and the lamps 10,20. Each output circuit 500,600 includes a resonant inductor 510,610, a DC blocking capacitor 560,660, a first rectifier 550,650, a resonant capacitor 530,630, and a second rectifier 570,670. The components of each output circuit 500,600 are interconnected in the same manner as previously described with reference to FIG. 5.

Although the present invention has been described with reference to certain preferred embodiments, numerous modifications and variations can be made by those skilled in the art without departing from the novel spirit and scope of this invention.

What is claimed is:

1. An electronic ballast for powering a gas discharge lamp, comprising:

an inverter, comprising:

first and second input terminals adapted to receive a source of substantially direct current (DC) voltage;

an inverter output terminal; and wherein the inverter is operable to provide a periodically varying voltage between the inverter output terminal and a circuit ground node; and an output circuit, comprising:

first and second output wires for connection to the gas discharge lamp;

a resonant inductor coupled between the inverter output terminal and the first output wire;

a resonant capacitor coupled between the first output wire and a first node;

a first rectifier having an anode coupled to the first node and a cathode coupled to the second output wire;

a DC blocking capacitor coupled between the second output wire and the circuit ground node;

a second rectifier having an anode coupled to the circuit ground node and a cathode coupled to the first node; and wherein the first rectifier is operable, in response to disconnection of the lamp from at least one of the first and second output wires, to provide a circuit path for peak-charging the DC blocking capacitor and thereby substantially eliminating any current flow through the resonant inductor and resonant capacitor.

2. The electronic ballast of claim 1, wherein the output circuit further comprises a voltage clamping diode having an anode coupled to the second output wire and a cathode coupled to the first input terminal of the inverter.

3. The electronic ballast of claim 1, wherein the inverter is operable to provide a substantially squarewave voltage between the inverter output terminal and the circuit ground node.

4. The electronic ballast of claim 1, wherein the inverter further comprises:

a first inverter switch coupled between the first input terminal and the inverter output terminal;

a second inverter switch coupled between the inverter output terminal and the circuit ground node, wherein the second input terminal is coupled to the circuit ground node; and an inverter driver circuit coupled to the first and second inverter switches and operable to turn the inverter switches on and off in a substantially complementary fashion.

5. An electronic ballast for powering a plurality of gas discharge lamps, comprising:

an inverter, comprising:

first and second input terminals adapted to receive a source of substantially direct current (DC) voltage;

an inverter output terminal; and wherein the inverter is operable to provide a periodically varying voltage between the inverter output terminal and a circuit ground node; and a plurality of output circuits, wherein each output circuit is coupleable to a gas discharge lamp, and each output circuit comprises:

first and second output wires coupleable to a gas discharge lamp;

a resonant inductor coupled between the inverter output terminal and the first output wire;

a resonant capacitor coupled between the first output wire and a first node;

a first rectifier having an anode coupled to the first node and a cathode coupled to the second output wire;

a DC blocking capacitor coupled between the second output wire and the circuit ground node;

a second rectifier having an anode coupled to the circuit ground node and a cathode coupled to the first node; and wherein the first rectifier is operable, in response to disconnection of the lamp from at least one of the first and second output wires, to provide a circuit path for peak-charging the DC blocking capacitor and thereby substantially eliminating any current flow through the resonant inductor and resonant capacitor.

6. The electronic ballast of claim 5, wherein the inverter is operable to provide a substantially squarewave voltage between the inverter output terminal and the circuit ground node.

7. The electronic ballast of claim 5, wherein the inverter further comprises:

a first inverter switch coupled between the first input terminal and the inverter output terminal;

a second inverter switch coupled between the inverter output terminal and the circuit ground node, wherein the second input terminal is coupled to the circuit ground node; and an inverter driver circuit coupled to the first and second inverter switches and operable to turn the inverter switches on and off in a substantially complementary fashion.

8. An electronic ballast for powering a gas discharge lamp, comprising:

an inverter, comprising:

first and second input terminals adapted to receive a source of substantially direct current (DC) voltage;

an inverter output terminal; and wherein the inverter is operable to provide a periodically varying voltage between the inverter output terminal and a circuit ground node; and an output circuit for connection to the gas discharge lamp, wherein the gas discharge lamp has first and second ends, and the output circuit comprises:

a hot output wire for connection to the first end of the gas discharge lamp;

a lamp return wire for connection to the second end of the gas discharge lamp and coupled to the circuit ground node;

a resonant inductor coupled between the inverter output terminal and a first node;

a DC blocking capacitor coupled between the first node and the hot output wire;

a first rectifier having an anode coupled to the hot output wire and a cathode coupled to a second node;

a resonant capacitor coupled between the second node and the circuit ground node;

a second rectifier having an anode coupled to the second node and a cathode coupled to the first node; and wherein the first rectifier is operable, in response to disconnection of the lamp from at least one of the hot output wire and the lamp return wire, to provide a circuit path for peak-charging the DC blocking capacitor, thereby substantially eliminating any current flow through the resonant inductor and resonant capacitor.

9. The electronic ballast of claim 8, wherein the inverter is operable to provide a substantially squarewave voltage between the inverter output terminal and the circuit ground node.

10. The electronic ballast of claim 8, wherein the inverter further comprises:

a first inverter switch coupled between the first input terminal and the inverter output terminal;

a second inverter switch coupled between the inverter output terminal and the circuit ground node, wherein the second input terminal is coupled to the circuit ground node; and an inverter driver circuit coupled to the first and second inverter switches and operable to turn the inverter switches on and off in a substantially complementary fashion.

11. An electronic ballast for powering a plurality of gas discharge lamps, comprising:

an inverter, comprising:

first and second input terminals adapted to receive a source of substantially direct current (DC) voltage;

an inverter output terminal; and wherein the inverter is operable to provide a periodically varying voltage between the inverter output terminal and a circuit ground node;

a plurality of output circuits, wherein each output circuit is for connection to a gas discharge lamp having first and second ends, and each output circuit comprises:

a hot output wire for connection to the first end of the gas discharge lamp;

a resonant inductor coupled between the inverter output terminal and a first node;

a DC blocking capacitor coupled between the first node and the hot output wire;

a first rectifier having an anode coupled to the hot output wire and a cathode coupled to a second node;

a resonant capacitor coupled between the second node and the circuit ground node; and a second rectifier having an anode coupled to the second node and a cathode coupled to the first node;

wherein the plurality of output circuits includes a lamp return wire coupled to the circuit ground and for connection to the second end of each gas discharge lamp; and wherein the first rectifier is operable, in response to disconnection of the lamp from at least one of the hot output wire and the lamp return wire, to provide a circuit path for peak-charging the DC blocking capacitor, thereby substantially eliminating any current flow through the resonant inductor and resonant capacitor.

12. The electronic ballast of claim 11, wherein the inverter is operable to provide a substantially squarewave voltage between the inverter output terminal and the circuit ground node.

13. The electronic ballast of claim 11, wherein the inverter further comprises:

a first inverter switch coupled between the first input terminal and the inverter output terminal;

a second inverter switch coupled between the inverter output terminal and the circuit ground node, wherein the second input terminal is coupled to the circuit ground node; and an inverter driver circuit coupled to the first and second inverter switches and operable to turn the inverter switches on and off in a substantially complementary fashion.

* * * * *